United States Patent [19]

Mykleby

[11] 4,029,206

[45] June 14, 1977

[54] CABLE STORAGE PACKAGE

[75] Inventor: Laurie G. Mykleby, Palos Park, Ill.

[73] Assignee: Coronet Container, Lombard, Ill.

[22] Filed: Sept. 22, 1975

[21] Appl. No.: 615,473

[52] U.S. Cl. ..... 206/400; 206/819; 428/73; 428/116

[51] Int. Cl.[2] ..... B65D 85/67; B32B 29/00

[58] Field of Search ..... 206/389, 398, 400–401, 206/521, 819; 229/3.5 R, 87 R; 242/118.4, 159, 170, 172; 428/72–73, 116, 118

[56] References Cited

UNITED STATES PATENTS

| | | | |
|---|---|---|---|
| 1,366,147 | 1/1921 | Worthington | 428/116 |
| 2,818,170 | 12/1957 | Hogan | 206/400 |
| 3,259,961 | 7/1966 | Bryand | 428/116 X |
| 3,669,820 | 6/1972 | Fredericks | 428/116 |
| 3,876,073 | 4/1975 | Herbetko | 206/400 |

*Primary Examiner*—Steven E. Lipman

*Attorney, Agent, or Firm*—Allegretti, Newitt, Witcoff & McAndrews

[57] ABSTRACT

A package for the storage of cable. The package includes a rigid cylindrical central core and a pair of spaced, circular flanges rigidly interconnected to the opposite ends of the core in substantially parallel relationship. A cable receiving space is defined between the flanges and on the core with the cable being positioned in the cable receiving space. A flexible cable cover of unique design is mounted over the stored cable and between the flanges. The cable cover comprises a continuous outer flexible sheet, preferably of a paper material, and a plurality of upright supporting walls which are secured to the sheet along one side and which define a plurality of transverse cells, the cells being positionable against the outermost layer of cable. Straps are provided for rigidly securing the flexible cover around the cable and between the flanges.

6 Claims, 5 Drawing Figures

CABLE STORAGE PACKAGE

BACKGROUND OF THE INVENTION—FIELD OF THE INVENTION AND DESCRIPTION OF THE PRIOR ART

This invention relates to a package for the storage of cable and it particularly relates to the storage of a large quantity of insulated multi-strand cable, such as telephone cable, on large storage reels.

Traditionally, cable, such as telephone cable, has been stored on large reels comprising a core and a pair of spaced parallel flanges. When the desired amount of cable has been wound around the core and between the flanges in the cable storage space of the reel, the outer exposed layer of the wound cable must be protected. This has generally been accomplished by placing rigid wood slats, such as two-by-fours, in side-by-side relationship, in the space between the outer periphery of each of the flanges in order to cover and protect the cable. The two-by-fours are normally rigidly strapped into place. This construction, sometimes called "lag" or "lagging", is generally considered to be an effective protective barrier for the cable, but the package or covering is considered expensive from the standpoint of both labor and material.

In order to overcome some of the disadvantages of the conventional "lagging" cable protection, as discussed above, it is to be realized that it is primarily the cable insulation that must be protected. In order to properly protect the insulation material on the cable, the exterior protective covering or "lagging" must be highly resistant to exterior forces, as from a heavy foreign object, such as another cable reel, damaging the insulation. It is important that the covering should prevent a foreign object from striking the cable insulation, so as to cause damage thereto. The cover material should also have some yield so that its inner surface will conform to the covered outer layers of cable on the reel so as to distribute the force of the impact from the foreign object, over a relatively large surface area of the insulation. The material must be sufficiently flexible so as to be wrapped around the cable on the reel at a radius of as little as 18 inches, as when the reel is not full, to a 4 foot radius, when the reel is full.

One newer type of protective material for cable generally comprises separate pieces of rigid foam plastic mounted on a fiber material which is wrapped around the reel. The material is then strapped in place. Although this protective material has been relatively successful, such a material is expensive and it is difficult to achieve a consistently satisfactory product because of hand operations required in gluing or sewing individual pieces of foam plastic together onto the fiber material.

SUMMARY OF THE INVENTION

It is therefore an important object of this invention to provide an improved package for insulated cable wherein the package is characterized by its simplicity and economy of construction and use.

It is also an important object of this invention to provide a unique package for the storage and protection of insulated cable on large reels wherein the package is characterized by a unique unitarily formed covering, of economical construction, which is wrapped around and against the outer layers of cable, between the flanges, in order to provide the desired physical protection for the outer layers of cable.

It is another important object of this invention to provide an improved covering for the protection of insulated cable wrapped on large cable storage reels wherein the covering comprises a flexible, continuous protective covering which may be wrapped around the reel and securely set into place.

Further purposes and objects of this invention will appear as the specification proceeds.

The foregoing objects are accomplished by providing an improved package for the storage of insulated cable wherein the package generally includes a reel having a central cylindrical core and a pair of spaced flanges rigidly mounted on the opposite ends of the core; a cable receiving space is defined between the flanges and on the core with the cable being wrapped in the cable receiving space; a cable covering is mounted over the cable and between the flanges; the cable cover comprises a continuous outer flexible sheet and a plurality of upright walls, defining a plurality of cells, rigidly secured to the sheet, the cells being positionable against the cable; and strapping being provided for rigidly securing the cover around the cable and between the flanges.

BRIEF DESCRIPTION OF THE DRAWINGS

One particular embodiment of the present invention is illustrated in the accompanying drawings, wherein.

DETAILED DESCRIPTION OF THE PREFERRED EMBODIMENT

Figure 1:
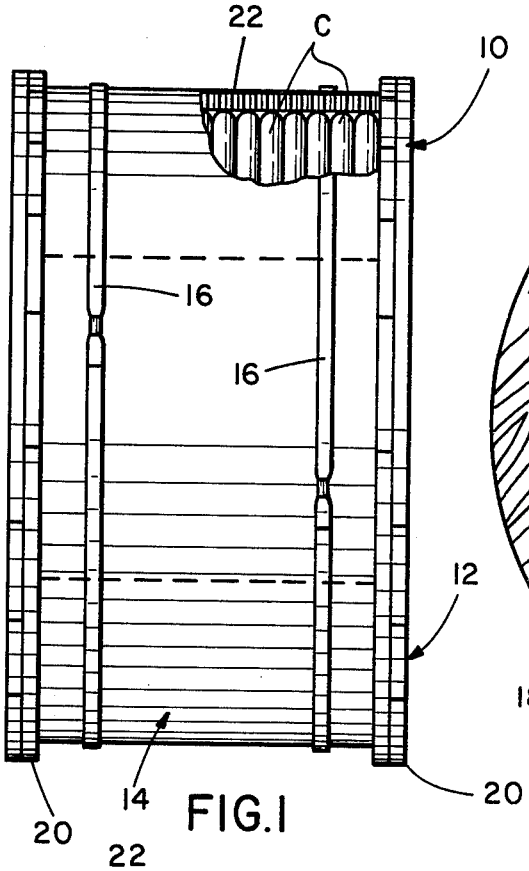
FIG. 1, is a front elevational view, partially broken, showing my improved package for storing insulated cable with a unique cable covering mounted on the cable storage reel.
Figure 2:
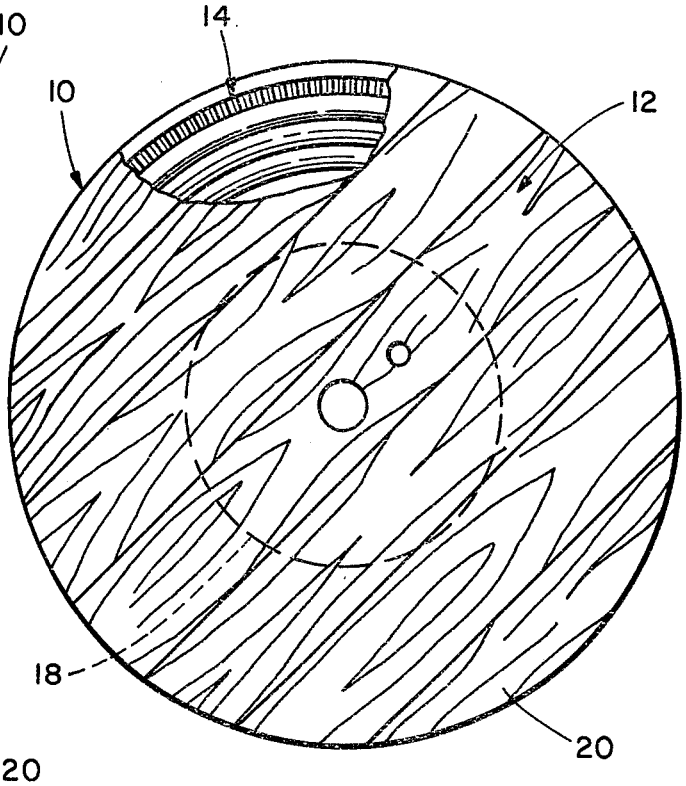
FIG. 2, is a partially broken end view of the embodiment of FIG. 1.
Figure 3:
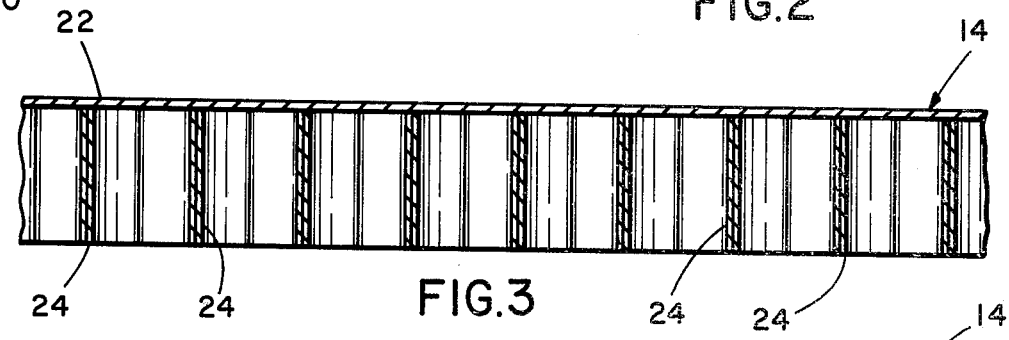
FIG. 3, is a detailed cross-sectional view taken along the line 3—3 of FIG. 4, showing the flexible material used for covering and protecting the insulated cable stored on the reel shown in FIGS. 1 and 2.

Referring to the drawings, particularly FIGS. 1 and 2, one embodiment of my improved package, generally 10, useful for the storage of cable C is shown. Generally, the package 10 includes a reel, generally 12, a protective covering generally 14, for the cable C, and strapping 16 for securing the covering material 14, in place on the package 10.

The reel 12 comprises a central core 18, as seen best in FIG. 2, having a pair of rigid flanges 20 mounted on its opposite ends in parallel relationship, as best seen in FIG. 1. The central core 18 preferably has a cylindrical outer periphery. The flanges 20 are preferably circular in shape and are concentrically mounted, relative to the core 18, on the opposite ends of the core 18 to define the reel 12. The core 18 and flanges 20 are desirably constructed of a rigid material, such as wood. The reel 12 itself is of a well known construction and may be the type which has been used for many years for the storage of cable C, such as telephone cable and the like.

The cable C, such as telephone cable, having a diameter of one inch, or thereabouts, is wound around the outer periphery of the core 18 in the space defined between the flanges 20 and core 18. The core 18 normally has a diameter of about 18 inches while the outer periphery of the circular flanges 20 of the reel 12 normally has a diameter of about 4 feet. The linear distance between the parallel flanges 20 may vary and normally is approximately 2—2 ½ feet apart.

Once the cable C has been wrapped in place on the reel 12, it is important to protect the insulation layers on the center of the cable C. Normally, the cable C has a tough flexible outer plastic electrical insulation material. The cable C normally carries a multitude of individual wires, also which are insulated. It is most important to protect the outer layer of the cable C that is wrapped on the reel 12 in order to protect the insulation from damage from a foreign object, such as another reel. The unique covering material 14 accomplishes this purpose.

Figure 4:
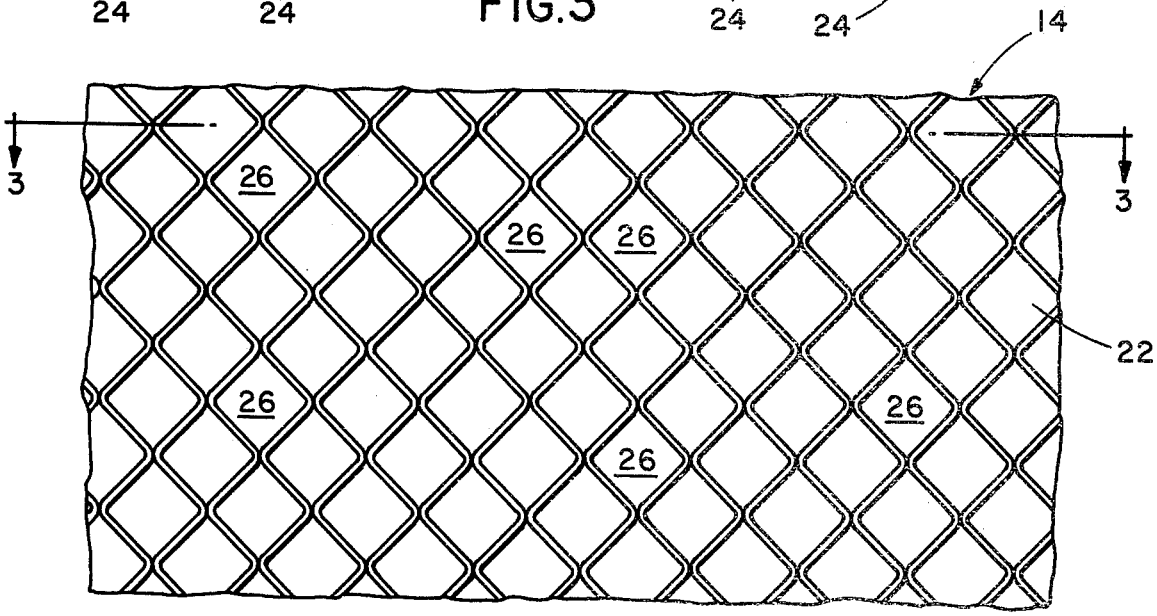
FIG. 4, is an interior plan view of the covering material used for the protection of the insulated cable stored on the reel of FIGS. 1 and 2.

The covering material 14 is flexible and may be made to conform to the outermost layers of the cable C mounted on the reel 12. Preferably, the covering material 14 comprises a continuous flexible sheet 22 and a plurality of upright walls 24 bonded on one edge only thereof to one surface of the continuous flexible sheet 22. The walls 24 are placed into close proximity to define a plurality of cells 26 which define a honeycomb arrangement, as seen in FIG. 4.

In placing the cover material 14 over the cable C wrapped on reel 12, the outer flexible sheet 22 is placed on the outer side and the opposite side of the cover 14, comprising the outer edges of the cell-defining walls 24, are placed into contact with the outer layers of the cable C, as seen best in FIG. 2. As is apparent from FIG. 2, the cells 26 may be compressed towards each other when the covering material 14 is bent into a circular configuration and wrapped around the cable C for protection thereof. Preferably, the walls 24 and flexible sheet 22 are constructed of a Kraft paper. Preferably, the cell walls 24 have a thickness of approximately 0.014 inches and the flexible sheet has a thickness of 0.019 inches, preferably a Kraft liner board. The overall thickness of the cover material may vary, but is advantageously approximately 15/16 of an inch. The covering material preferably comprises a pair of steel straps 16 which are wrapped around the cover material and secured in place by using known equipment.

Material of the described type (0.014 inch walls, 15/16 inches thick, 0.019 inch sheet) was subjected to a Cunbur Incline Impact Tester. This tester comprises a dolly running down a 10° inclined track against a solid flat hazard. A container is placed on the dolly with the face or edge, which is to receive the impact, flush with the forward end of the dolly. The dolly is brought to a predetermined position on the incline and released.

The crushing strength or stacking strength of the cover material was determined on an Olson Compression Testing Machine, operated at 0.5 inch per minute with a floating top platen. Deflection and loading are measured.

The Beach puncture test is a measure of the energy required to force a puncture head of a designated size and shape completely through a sample of material. The measured value is dependent on the resistance to puncture and the stiffness of the board. It is conducted on a TMI Beach Tester, which has been approved by ASTM and TAPPI. Shock measurements are recorded by accelerometer sensors secured to items undergoing tests and read through an electronic shock amplifier which retains the data until reset by an operator. Measurements are reported as a g force. The results of the test of the cover material are as follows:

Incline Crush Tests

6 × 12 inches samples of material were subjected to 5 impacts from distances of 1′, 2′ and 3′. New samples were used for each increment of impact distance. Maximum shock transmission readings were recorded. The impact fixture, supplying crushing force, consists of a laminated hardwood block, approximately 10 × 2 ¼ × 3 ½inches, affixed securely to the leading edge of the dolly. The acceleromater transducer is mounted to a duralum plate backing the hardwood block.

| Sample 1 Impact No. | Impact Distance | Peak g |
|---|---|---|
| 1 | 1′ | 9 |
| 2 | 1′ | 13 |
| 3 | 1′ | 14 |
| 4 | 1′ | 24 |
| 5 | 1′ | 25 |
| | Avg. (Impacts 2 through 5) | 19.0 |
| Sample 2 | | |
| 1 | 2′ | 24 |
| 2 | 2′ | 52 |
| 3 | 2′ | 55 |
| 4 | 2′ | 76 |
| 5 | 2′ | 130 |
| | Avg. (Impacts 2 through 5) | 78.2 |
| Sample 3 | | |
| 1 | 3′ | 27 |
| 2 | 3′ | 112 |
| 3 | 3′ | 80 |
| 4 | 3′ | 80 |
| 5 | 3′ | 95 |
| | Avg. (Impacts 2 through 5) | 91.8 |

Beach Puncture Resistance:

455
450
450
450

RESULTS OF TESTS:

Static Compressive Stress-Strain:

| Deformation (in.) | Deformation (%) | Load (psi) |
|---|---|---|
| 0.0 | 0 | 0.0 |
| 0.1 | 10 | 20.6 |
| 0.2 | 20 | 22.6 |
| 0.3 | 30 | 16.4 |
| 0.4 | 40 | 15.8 |
| 0.5 | 50 | 15.6 |
| 0.6 | 60 | 34.4 |

Figure 5:
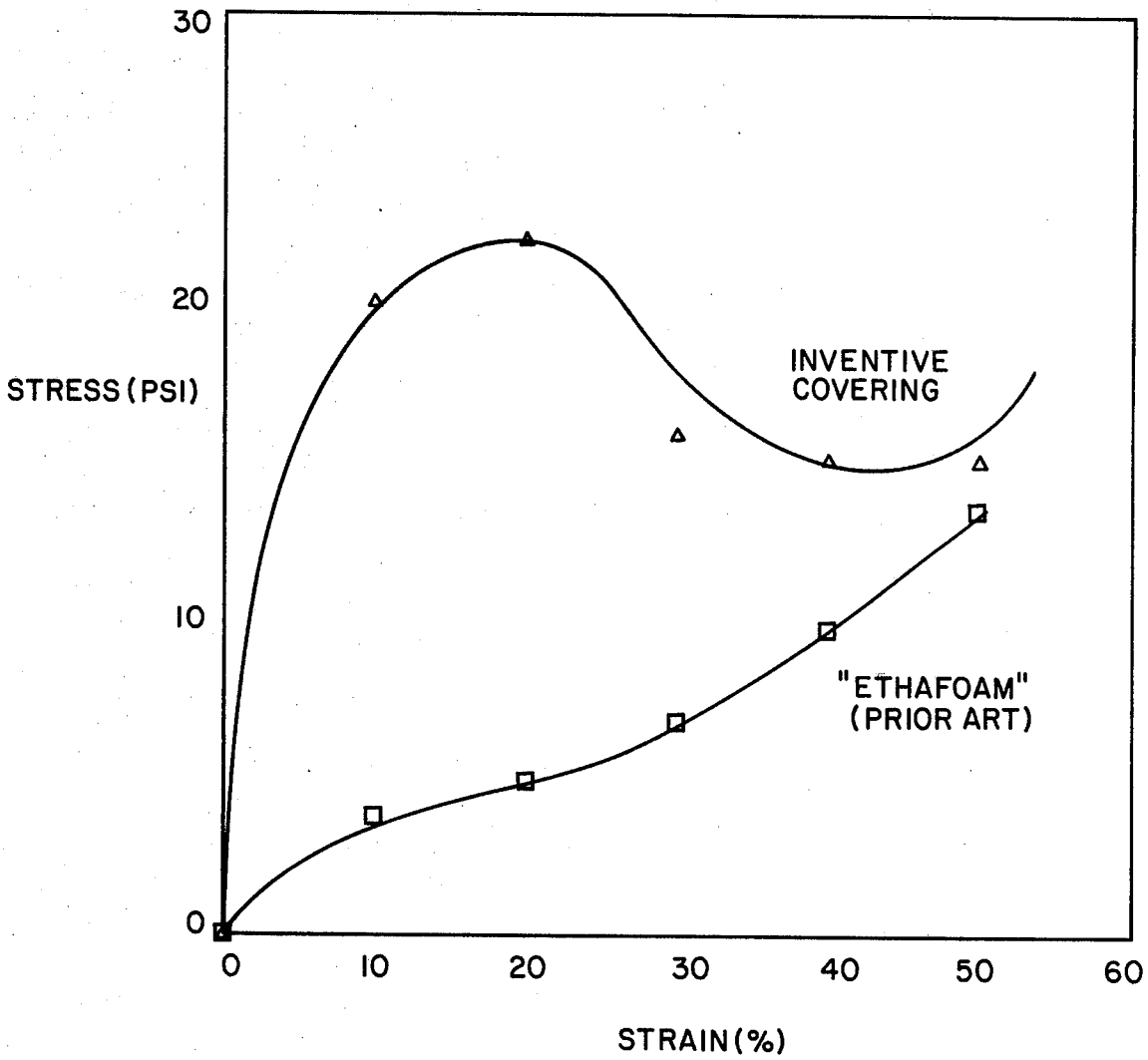
FIG. 5, is a stress-strain diagram illustrating test results on the cover material and compared to a commercial product.

See FIG. 5 for a graphical presentation of the above data and a comparison with Dow Chemical Ethafoam 220 cable protective material (The Data for Ethafoam$^R$ was taken from Dow Chemical Publication "Packaging with Ethafoam").

It is seen from the above that a highly useful and economical covering material for protecting cable on a reel has been provided. All of the objects previously set out have been accomplished as the package for storing the reel provides adequate strength for protecting the cable and yet the material is easily handled and stored.

While in the foregoing, there has been provided a detailed description of a particular embodiment of the present invention, it is to be understood that all equivalents obvious to those skilled in the art are to be included within the scope of the invention, as claimed.

What I claim and desire to secure by Letters Patent is:

1. A flexible packing material comprising only a continuous outer flexible sheet, and a plurality of upright walls in closely adjacent relationship defining adjacent cells and each wall having a first edge and a second edge, said first edges only being rigidly secured to one surface of said outer flexible sheet so that portions of said walls secured to said sheet are substantially incompressible towards each other, and said second edges of said walls being movable towards and away from each other along said second edges.

2. The article of claim 1 wherein said continuous outer flexible sheet and said upright walls are made of paper material.

3. The article of claim 2 wherein said walls are of substantially the same height and define a honeycomb formation.

4. A package for the storage of insulated multi-strand cable, said package comprising, in combination a rigid core, a pair of spaced flanges rigidly interconnected to said core in spaced relationship to each other, a cable receiving space defined between said flanges and on said core, cable being wound around the core between the flanges in said space, a flexible cable cover means for protecting said insulated cable, said cover means being wrapped around said cable and between said flanges, said cover means comprising only a continuous outer flexible sheet and a plurality of upright walls having a first edge and a second edge and defining a plurality of adjacent upright cells, said walls being secured to said sheet only along said first edge and not along said second edge and said second edge being positioned against the outer layer of said cable, and means for rigidly securing said cover around said cable.

5. The package of claim 5 wherein both said outer flexible sheet and said upright walls are constructed of a paper material of sufficient thickness to provide the desired strength for protecting said cable.

6. The package of claim 4 wherein said securing means comprises steel strapping.

* * * * *